US009027257B1

(12) United States Patent
Harker

(10) Patent No.: US 9,027,257 B1
(45) Date of Patent: May 12, 2015

(54) SYSTEM AND METHOD FOR CLEANING GRAIN DRYER SCREEN

(71) Applicant: Harry Harker, Hope, IN (US)

(72) Inventor: Harry Harker, Hope, IN (US)

( * ) Notice: Subject to any disclaimer, the term of this patent is extended or adjusted under 35 U.S.C. 154(b) by 0 days.

(21) Appl. No.: 14/135,828

(22) Filed: Dec. 20, 2013

(51) Int. Cl.
*F26B 19/00* (2006.01)
*F26B 25/00* (2006.01)

(52) U.S. Cl.
CPC ..... *F26B 25/00* (2013.01)

(58) Field of Classification Search
CPC ..... F26B 17/00; F26B 17/12; F26B 19/00
USPC ..... 34/174, 181, 102, 201, 210, 380, 381, 34/394
See application file for complete search history.

(56) References Cited

U.S. PATENT DOCUMENTS 3,419,056 A * 12/1968 Girgis ..... 426/482
3,538,618 A 11/1970 Neuenschwander
3,690,016 A 9/1972 Walhof et al.
4,020,561 A 5/1977 Mathews
4,036,613 A * 7/1977 Brown et al. ..... 55/294
4,142,302 A 3/1979 Primus
4,587,893 A 5/1986 Brockhaus et al.
5,098,341 A 3/1992 Kuchar
6,073,364 A 6/2000 McKenzie et al.
6,076,276 A 6/2000 McKenzie et al.
6,201,142 B1 3/2001 Maza
6,233,843 B1 5/2001 McKenzie et al.
7,568,297 B2 8/2009 Pierson et al.

FOREIGN PATENT DOCUMENTS

GB 249 744 A * 4/1926

* cited by examiner

*Primary Examiner* — Steve M Gravini
(74) *Attorney, Agent, or Firm* — SmithAmundsen LLC; Kelly J. Smith; Dennis S. Schell

(57) ABSTRACT

A system for cleaning a grain dryer screen includes a grain dryer screen supported within a grain bin and having a grain contacting surface opposing a grain debris contacting surface. A drying airflow path through the grain dryer screen is defined sequentially by the grain debris contacting surface and the grain contacting surface. A cleaning assembly includes a first cleaning arm mounted within the grain bin and disposed along the grain debris contacting surface. A cleaning assembly powering system is configured to move the first cleaning arm along a predetermined cleaning path relative to the grain debris contacting surface.

20 Claims, 7 Drawing Sheets

SYSTEM AND METHOD FOR CLEANING GRAIN DRYER SCREEN

TECHNICAL FIELD

The present disclosure relates generally to a cleaning assembly for cleaning a grain dryer screen of a grain bin.

BACKGROUND

Grain bins are used for storing a variety of bulk materials, including grains, such as corn and wheat. At harvest, these grains typically contain excess moisture and, thus, need to be dried sufficiently and soon after harvest, to prevent insect infestation and quality deterioration. The purpose of storage, after the drying process, is to provide the dried grains with protection against insects, molds, rodents and birds, and to prevent moisture from re-entering the grains. Grains may be dried using traditional sun drying or may be dried mechanically. Mechanical drying systems may include heater systems located internally or externally relative to the grain bin. One exemplary in-bin drying system includes a top dry grain drying system. According to a top dry system, a layer of grain introduced into an overhead drying chamber within a grain bin is dried by a fan and heater and then dumped to a cooling area below. According to some designs, a smaller aeration fan captures heat from this previously dried grain received in the holding area, and pushes it upward to help dry the next layer of grain.

With regard to the top dry grain drying system, and other similar systems, there is a continuing need to improve efficiency and safety of the systems and methods employed to dry and store bulk materials. The present disclosure is directed to such an effort.

SUMMARY OF THE DISCLOSURE

In one aspect, a system for cleaning a grain dryer screen includes a grain dryer screen supported within a grain bin and having a grain contacting surface opposing a grain debris contacting surface. A drying airflow path through the grain dryer screen is defined sequentially by the grain debris contacting surface and the grain contacting surface. A cleaning assembly includes a first cleaning arm mounted within the grain bin and disposed along the grain debris contacting surface. A cleaning assembly powering system is configured to move the first cleaning arm along a predetermined cleaning path relative to the grain debris contacting surface.

In another aspect, a method for cleaning a grain dryer screen is provided. The grain dryer screen is supported within a grain bin and has a grain contacting surface opposing a grain debris contacting surface. A drying airflow path through the grain dryer screen is defined sequentially by the grain debris contacting surface and the grain contacting surface. The method includes a step of supporting a first cleaning arm of a cleaning assembly within the grain bin and along the grain debris contacting surface of the grain dryer screen. Grain debris is collected from a drying airstream flowing along the airflow path at the grain debris contacting surface. The method also includes steps of moving the first cleaning arm along a predetermined cleaning path relative to the grain debris contacting surface using a cleaning assembly powering system, and removing the grain debris from the grain debris contacting surface during the step of moving the first cleaning arm.

DETAILED DESCRIPTION

Figure 1:
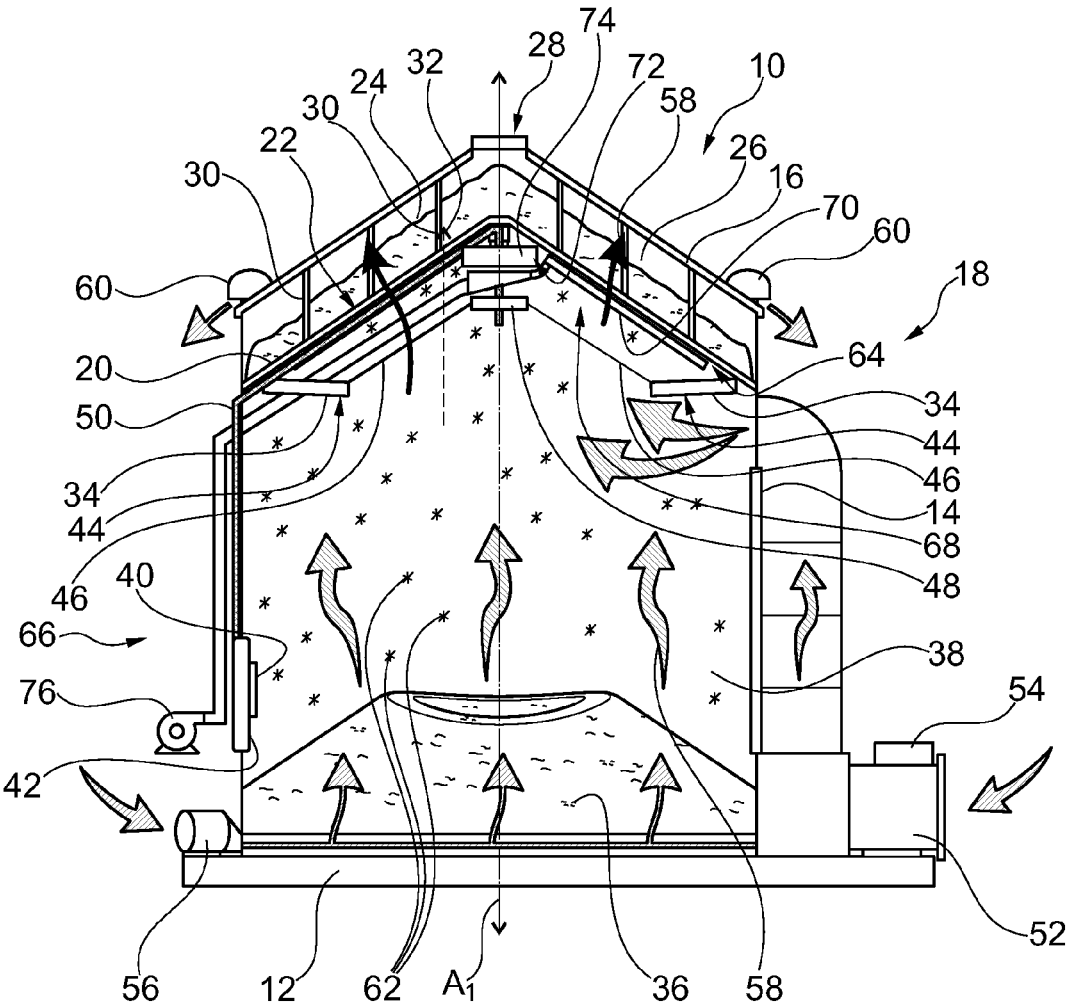
FIG. 1 is a side diagrammatic view of a grain bin having a top dry grain drying system and a system for cleaning a grain dryer screen of the top dry grain drying system, according to the present disclosure.

FIG. 1 illustrates an exemplary grain bin 10 configured for storing bulk materials, such as, for example, corn, soybeans, rice, wheat, and nuts. Although bulk materials other than those technically categorized as grains may be stored in the grain bin 10, the terms "grain" and "grains" will be used for the sake of simplicity to refer to any and all materials that may be dried and/or stored using the grain bin 10. The grain bin 10 may be made from any of a variety of materials and may have any desired size and shape. According to the exemplary embodiment, the grain bin 10 may include a floor 12, a sidewall 14, and a conical roof 16 together defining a generally cylindrical shape.

Figure 2:
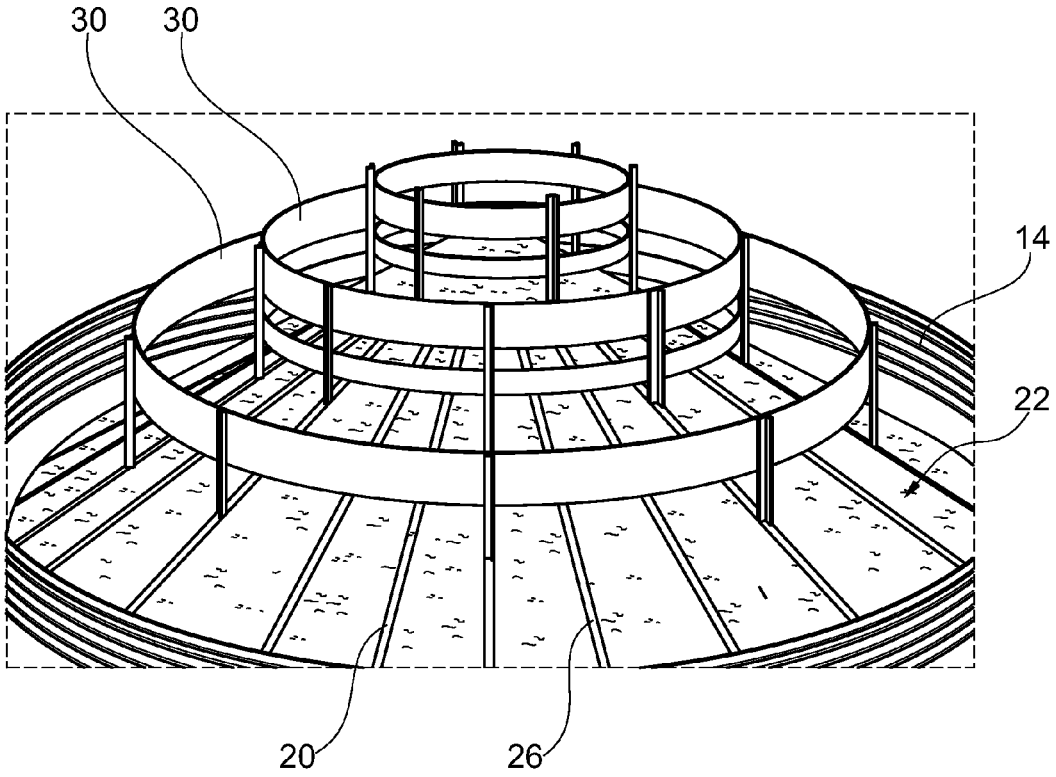
FIG. 2 is a perspective view of a top portion of the grain bin of FIG. 1, shown with the roof removed to reveal a grain contacting surface of the grain dryer screen.

The grain bin 10 may include a top dry grain drying system 18 configured for drying harvested grain deposited into the grain bin 10 for storage. According to the exemplary embodiment, the top dry grain drying system 18 may include a grain dryer screen 20 supported within the grain bin 10, using hardware or other known support means, and having a grain contacting surface 22, which may also be referred to as a top or upper surface. The grain dryer screen 20 and conical roof 16 may define at least a portion of an overhead drying chamber 24 of the grain bin 10. Although the grain dryer screen 20 is shown as having a conical shape, as particularly shown in the view of FIG. 2, which shows the grain bin 10 with the conical roof 16 removed, it should be appreciated that the size and configuration of the grain dryer screen 20 and, thus, overhead drying chamber 24 may vary depending on the particular application. For example, an angle of the grain contacting surface 22 may be selected to provide an angle of repose deemed suitable for a particular grain.

During operation of the top dry grain drying system 18, wet grain 26 may be received into the overhead drying chamber 24 through a central opening 28 of the conical roof 16 and distributed across the grain contacting surface 22 of the grain dryer screen 20. In particular, and with additional reference to FIG. 2, a plurality of leveling bands 30 may be mounted in the overhead drying chamber 24 and used to more strategically distribute a layer of wet grain 26 across the grain contacting surface 22. The grain dryer screen 20 is preferably perforated, as shown in later referenced FIGS. 3, 4, and 9, to permit air flowing upward along a drying airflow path 32 to pass through the grain dryer screen 20 and remove moisture from the wet grain 26, as will be described later in greater detail.

When the wet grain 26 has been dried to a predetermined level, dump chutes 34 may be actuated, or re-positioned, to let hot dried grain 36 fall by gravity to a holding area 38 below, where the hot dried grain 36 is cooled and stored. For example, a motor 40, or other source of mechanical power, may be used to lower, and then raise, the dump chutes 34 automatically in response to a predetermined event or responsive to manipulation of the motor 40 through a control box, or control panel, 42. As shown, free ends 44 of the dump chutes 34 may be maintained in raised positions (shown) by chains 46, or other similar support means, supported from a common platform, or plate, 48. The motor 40 may be used to move, or release, an actuation cable 50, which is configured to move the common platform 48, to lower the free ends 44 of the dump chutes 34 and move, or retract, the actuation cable 50 to return the free ends 44 of the dump chutes 34 to the raised positions.

A fan 52 may direct ambient air heated using a heating device 54 through the sidewall 14 of the grain bin 10 and into the overhead drying chamber 24. That is, the heated ambient air may advance along the drying airflow path 32 and through the grain dryer screen 20. Additionally, according to some embodiments, ambient air from a cooling fan 56 may capture and expel heat from the previously dried grain 36 at the bottom of the grain bin 10 and also advance along the drying airflow path 32. This drying airstream 58 absorbs moisture from the wet grain 26 and carries the moisture out of the grain bin 10. That is, after passing through the layer of wet grain 26 supported on the grain contacting surface 22 of the grain dryer screen 20, this drying airstream 58 may exit the grain bin 10 through one or more vents, such as auto-vents 60. The auto-vents 60 may include a specially shaped damper having a normally closed position. When the fans 52 and 56 and heater device 54 are operating, the drying airstream 58 pivots the damper to an open position, permitting advancement of the drying airstream 58 through the auto-vents 60.

As the drying airstream 58 flows along the drying airflow path 32, grain debris 62 from the processed grain (i.e., wet grain 26 and/or dried grain 36) may be transported by the drying airstream 58 and may collect on a grain debris contacting surface 64 of the grain dryer screen 20. The grain debris contacting surface 64 opposes the grain contacting surface 22 and generally represents the bottom, or underside, of the grain dryer screen 20. As should be appreciated, the drying airflow path 32 through the grain dryer screen 20 is defined sequentially by the grain debris contacting surface 64 and the grain contacting surface 22, based on the exemplary embodiment provided.

As stated above, the grain dryer screen 20 is preferably perforated, or otherwise configured, to permit the drying airstream 58 to pass up through the grain dryer screen 20 and into the overhead drying chamber 24. The perforations, or slots or openings, may typically be sized to permit passage of the drying airstream 58 but restrict passage of the wet grain 26, or other material, supported on the grain contacting surface 22. Alternatively, or additionally, the continuous drying airstream 58 flowing upward through the grain dryer screen 20 may resist passage of the wet grain 26 through the grain dryer screen 20. The perforations may also be sized to restrict passage of the grain debris 62 and/or the presence of the layer of wet grain 26 along the grain contacting surface 22 may prevent complete passage of the grain debris 62 upward through the perforations. Thus, particularly when the fans 52 and 56 and heater device 54 are operating, grain debris 62 may collect along the grain debris contacting surface 64.

According to the present disclosure, a system 66 for cleaning the grain dryer screen 20 includes a cleaning assembly 68 that includes at least a first cleaning arm 70, and preferably a series of cleaning arms, as will be described below, mounted within the grain bin 20 and disposed along the grain debris contacting surface 64, as shown in FIG. 1. An innermost end 72 of the first cleaning arm 70, relative to a central axis $A_1$ through the grain debris contacting surface 64, may open at a central manifold 74 positioned upstream relative to a suction device 76. As will be discussed below, the suction device 76 may generate suction through the first cleaning arm 70 to remove grain debris 62 from the grain debris contacting surface 64 of the grain dryer screen 20, in a manner similar to that of a vacuum cleaner.

Figure 3:
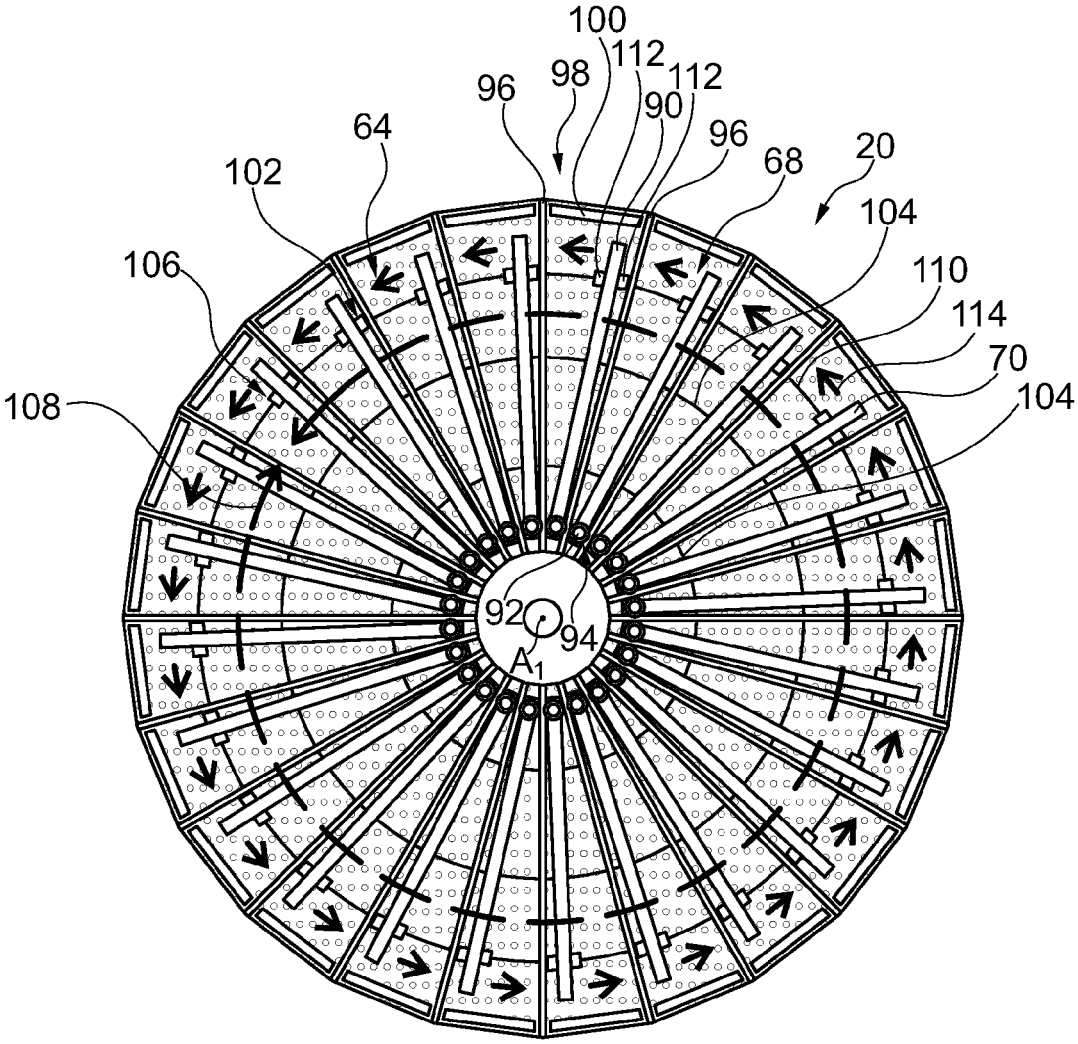
FIG. 3 is a bottom view of the grain dryer screen of previous FIGS. 1 and 2, depicting a set of channeled cleaning arms of the system for cleaning a grain debris contacting surface of the grain dryer screen.

Turning now to FIG. 3, an exemplary embodiment of portions of the cleaning system 66 will be described. In particular, the cleaning assembly 68 of the cleaning system 66 may include a set of channeled cleaning arms 90, which may include the first cleaning arm 70. Each channeled cleaning arm 90 may have a radial orientation, relative to the central axis $A_1$ through the grain debris contacting surface 64, and may include an opening 92 at an innermost end 94 thereof for fluidly connecting the channeled cleaning arm 90 to the central manifold 74 of FIG. 1. In addition, each channeled cleaning arm 90 may be disposed between adjacent rafters 96 of the grain dryer screen 20. The rafters 96, which may provide structural support for the grain dryer screen 20, may extend outwardly, or perpendicularly, from the grain debris contacting surface 64 of the grain dryer screen 20 and may divide the grain debris contacting surface 64 into a plurality of wedge-shaped, or pie-shaped, portions 98. The grain dryer screen 20 may also include a plurality of openings 100 therethrough, corresponding to the dump chutes 34 of FIG. 1, to permit passage of dried grain 36 to the holding area 38 below. Since each wedge-shaped portion 98 of the grain debris contacting surface 64 may be substantially similar, the items of only one wedge-shaped portion 98 are called out. It should be appreciated, however, that similar items appear in each wedge-shaped portion 98.

A cable system 102 may be used to support the channeled cleaning arms 90 against the grain debris contacting surface 64. The cable system 102 may include one or more non-powered cables 104 positioned through the channeled cleaning arms 90 and the rafters 96. As should be appreciated, the non-powered cables 104 may be positioned through openings through the channeled cleaning arms 90 and the rafters 96, or may be otherwise supported, and may be sized or tensioned to maintain an engagement of the channeled cleaning arms 90 with the grain debris contacting surface 64. As shown, the non-powered cables 104 may run concentrically in a predetermined pattern and may include a number of non-powered cables 104 selected to provide the desired support and engagement of the channeled cleaning arms 90 along the grain debris contacting surface 64. An alternative system or set of structures, such as a series of rods, may replace the cable system 102 for supporting the channeled cleaning arms 90 relative to the grain debris contacting surface 64.

Still referring to FIG. 3, the cleaning system 66 may also include a cleaning assembly powering system 106 configured to move each channeled cleaning arm 90 along a predetermined cleaning path 108, such as a circular path, relative to the grain debris contacting surface 64. The channeled cleaning arms 90 may be interconnected with the cable system 102 such that the cleaning assembly powering system 106, which will be discussed in greater detail below, may move the channeled cleaning arms 90 simultaneously, or near simultaneously, along the predetermined cleaning path 108. In particular, for example, the cable system 102 may also include at least one powered cable 110 passing through the channeled cleaning arms 90 and the rafters 96, and mechanisms 112 (shown also in FIG. 6) for holding the channeled cleaning arms 90 stationary with respect to the powered cable 110 such that the channeled cleaning arms 90 and powered cable 110 move together. Mechanisms 112 may include any hardware, such as cable clamps or the like, for securing the channeled cleaning arms 90 to the powered cable 110 for movement together.

The cleaning assembly powering system 106, which may receive driving power as described below, may be configured to move the channeled cleaning arms 90 along the predetermined cleaning path 108 in a first direction about the central axis $A_1$, as indicated by arrows 114, with a range of movement of each channeled cleaning arm 90 being limited by the rafters 96. That is, each channeled cleaning arm 90 may have a range of movement limited to the respective wedge-shaped portion 98 of the grain debris contacting surface 64. The cleaning assembly powering system 106 may also be configured to move the channeled cleaning arms 90, using the powered cable 110, in a second direction about the central axis $A_1$ that is opposite the first direction, as indicated by arrows 116 of FIG. 4.

Figure 4:
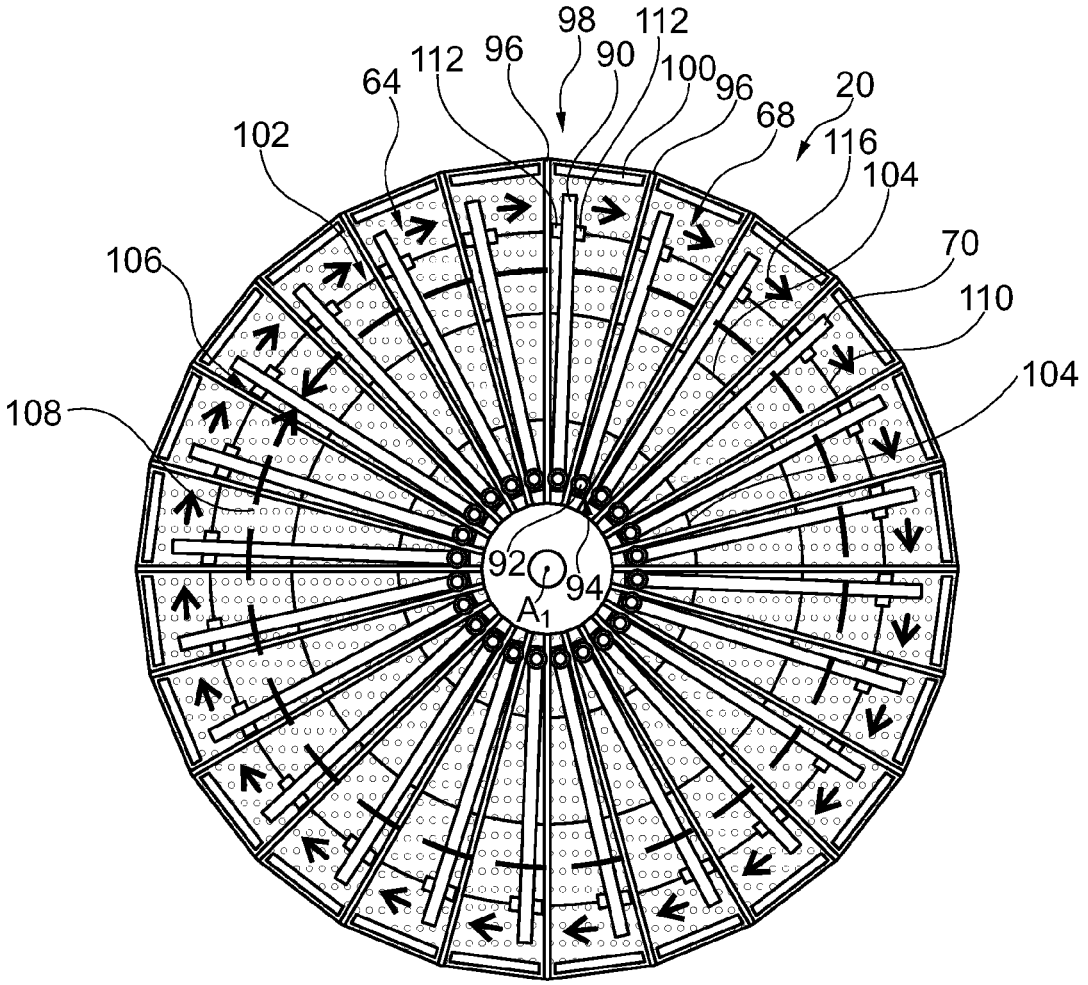
FIG. 4 is a view similar to the view of FIG. 3, depicting the set of channeled cleaning arms moved from first positions of FIG. 3 to second positions.

For example, during operation of the cleaning system 66, the powered cable 110 of the cable system 102 may be moved along the predetermined cleaning path 108 in the first direction, as indicated by arrows 114 of FIG. 3, to move the channeled cleaning arms 90 from first, or initial, positions of FIG. 3 to second positions depicted in FIG. 4. The powered cable 110 may then be moved along the predetermined cleaning path 110 in the opposite direction, as indicated by arrows 116 of FIG. 4, to return the channeled cleaning arms 90 to the first positions of FIG. 3. These movements may be repeated at a speed and duration selected to provide a desired cleaning effect. As will be described below, these movements may be driven by and/or coordinated with the movement of actuation cable 50 and, thus, movements of the channeled cleaning arms 90 may coincide with the movements of the dump chutes 34.

Figure 5:
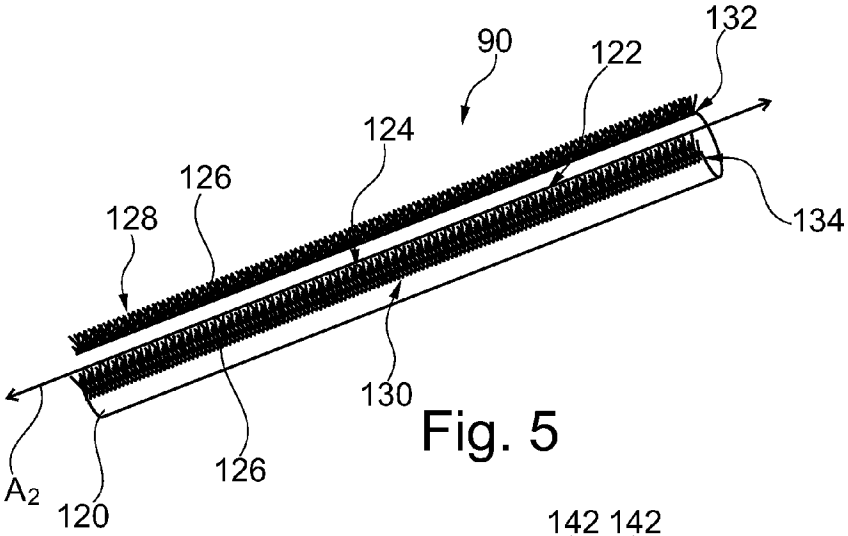
FIG. 5 is a perspective view of one embodiment of a channeled cleaning arm that may be used with the cleaning system of the present disclosure.

Turning now to FIG. 5, each channeled cleaning arm 90 may include a channeled body 120 defining an interior space 122 that may be positioned in fluid communication with the suction device 76 for generating suction through the channeled body 120. Although a U-shaped or semi-circular cross-sectional shape is shown for the channeled body 120, any of a variety of different cross-sectional shapes may be used. Further, although a channeled shape is shown that does not completely enclose the interior space 122, alternative embodiments may include a tubular body surrounding the interior space 122 that includes one or more openings therethrough. These openings, or a continuous passage 124 of the exemplary embodiment, may provide a passageway for drawing grain debris 62 into the channeled cleaning arm 90 using suction. Thus, according to the exemplary embodiment, it may be desirable to support the continuous passage 124, or other openings, of the channeled cleaning arm 90 in close proximity to the grain debris contacting surface 64 to improve collection of grain debris 62 at the grain debris contacting surface 64.

Figure 6:
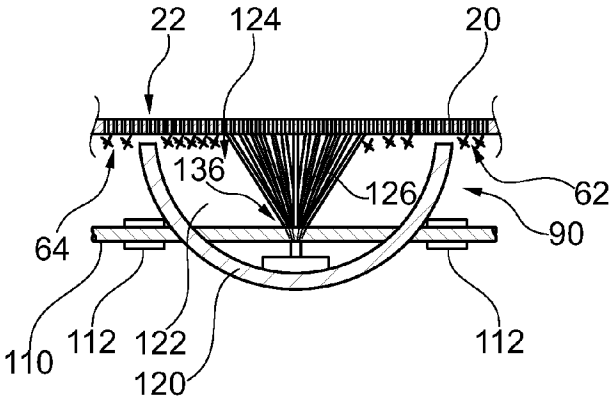
FIG. 6 is a cross sectional view of an alternative embodiment of a channeled cleaning arm that may be used with the cleaning system of the present disclosure.
Figure 7:
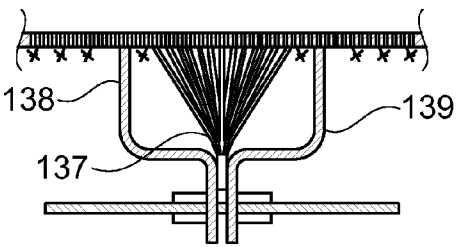
FIG. 7 is a cross sectional view of another alternative embodiment of a channeled cleaning arm that may be used with the cleaning system of the present disclosure.

The channeled cleaning arm 90 may also include bristles 126 for brushing the grain debris contacting surface 64. According to the embodiment of FIG. 5, the bristles 126 may be provided in first and second strips 128 and 130 supported at or near edges 132 and 134 defining the continuous passage 124 into the channeled body 120. That is, each of the first and second strips 128 and 130 may extend along a longitudinal axis $A_2$ of the channeled cleaning arm 90 and may be positioned to contact the grain debris contacting surface 64 during operation of the cleaning system 66. Alternatively, and perhaps preferably, as shown in FIG. 6, the channeled cleaning arms 90 may include a central strip 136 of bristles 126 supported within the channeled body 120 and positioned to contact the grain debris contacting surface 64 during operation. Again, the bristles 126 may be used to remove or agitate grain debris 62 relative to the grain debris contacting surface 64 to assist in the suctioning of the grain debris 62 through the channeled cleaning arms 90. According to some embodiments, as shown in FIG. 7, a strip of bristles 137 may be pressed, or otherwise held or fastened, between two elongate sidewalls 138 and 139 made from metal, plastic, or another suitable material.

Figure 8:
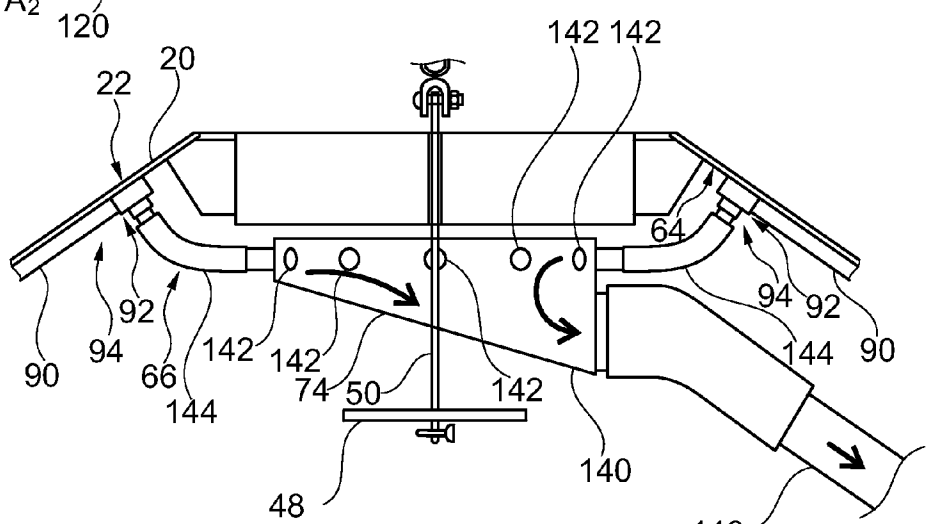
FIG. 8 is a side diagrammatic view of a central manifold that may be fluidly connected with the set of channeled cleaning arms shown in FIGS. 3 and 4 and positioned upstream relative to a suction device of the cleaning system disclosed herein.

With reference to FIG. 8, the central manifold 74 may include a body 140 with openings 142 configured for fluidly attaching the channeled cleaning arms 90 to the central manifold 74. For example, a connection tube 144, which may be a flexible tube, may extend from the opening 92 at the innermost end 94 of the channeled cleaning arm 90 to the corresponding opening 142 of the central manifold 74. The central manifold 74 may be stationary with respect to the grain dryer screen 20 and, thus, the connection tube 144 may be configured to permit movement of the channeled cleaning arm 90 relative to the central manifold 74. During operation, grain debris 62 may be pulled into the channeled bodies 120 of the channeled cleaning arms 90 using suction generated by the suction device 76. The suction device 76, according to some embodiments, may include a centrifugal fan or axial fan, for example, fluidly connected with the central manifold 74 using a high pressure delivery hose 146, or other similar pipe or tube. It should be appreciated that the type and size of suction device 76 selected may vary according to the specific application and may be chosen to provide desired suction. According to some embodiments, a turbocharger may be used to draw the grain debris 62 through the channeled cleaning arms 90. For instance, the turbocharger may be powered by a turbine that is driven, at least in part, by the drying airstream 58.

Figure 9:
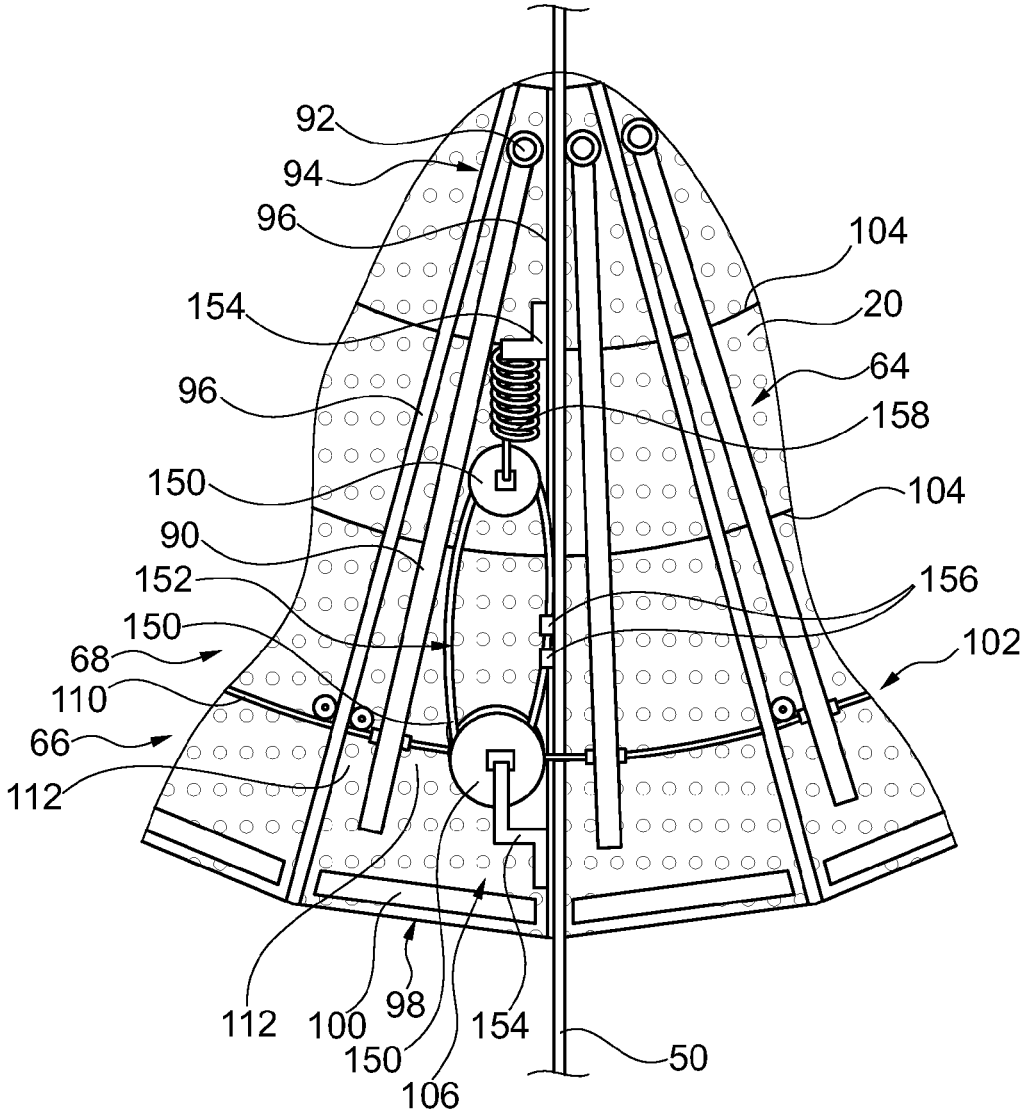
FIG. 9 is a bottom view of a portion of the grain dryer screen depicting an exemplary cable system for coordinating movement of the set of channeled cleaning arms with movement of a dump chute of the grain bin.

The movement of the actuation cable 50, which may be powered by the motor 40, may also be used to drive the cable system 102. For example, the motor 40, or other source of mechanical power, may be configured to simultaneously drive the cable system 102 and actuate the dump chutes 34 of the grain bin 10. To effect such simultaneous movement, the actuation cable 50 and the powered cable 110 of the cable system 102 may be coupled to move together, as shown in FIG. 9. In particular, pulleys 150 may be used to change direction of the powered cable 110 such that at least a segment 152 of the powered cable 110 is substantially aligned with the actuation cable 50. The pulleys 150 may be attached to the rafters 96 using angled brackets 154, or other known attachments means.

Figure 10:
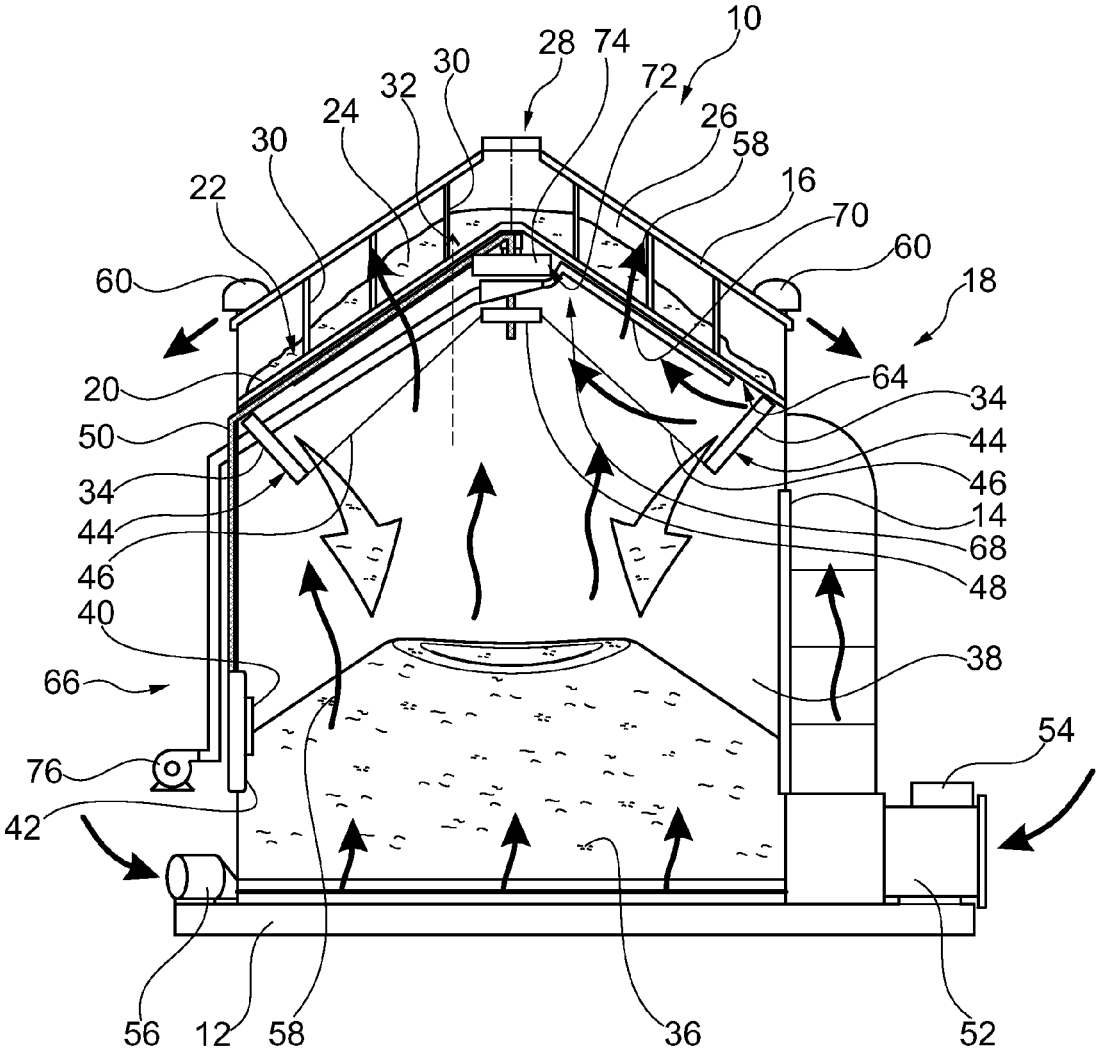
FIG. 10 is a side diagrammatic view of the grain bin of FIG. 1, shown with dump chutes of the grain bin in actuated positions.

Along the aligned segment 152, the actuation cable 50 and the powered cable 110 may be coupled to move together using cable clamps 156, or other similar devices. The motor 40 may then be used to simultaneously lower the free ends 44 of the dump chutes 34, as shown in FIG. 10, and move the channeled cleaning arms 90 in the first direction, as represented by arrows 114, from the first positions of FIG. 3 to the second positions FIG. 4. The motor 40 may also be used to simultaneously return the free ends 44 of the dump chutes 34 to the raised positions shown in FIG. 1 and move the channeled cleaning arms 90 in the second direction, as depicted using arrows 116, to return the channeled cleaning arms 90 to the first positions of FIG. 3. One or more springs 158 may be used to attach one or more of the pulleys 150 to the respective attachment feature to assist in maintaining tension of the powered cable 110.

According to some implementations, the actuation cable 50 and powered cable 110 may be actuated simultaneously, and manually or automatically when a predetermined temperature and/or moisture content of the grain is achieved. For example, after a predetermined period of time or when the predetermined temperature and/or moisture content is detected, or sensed, the dump chutes 34 may be actuated and, at the same time, the grain debris 62 may be removed from the grain debris contacting surface 64. This may occur whether or not the fans 52 and 56 and the heating device 54 remain operational. However, one or both of the fans 52 and 56 may assist in maintaining the grain debris 62 against the grain debris contacting surface 64 so that it may be removed more easily using the cleaning system 66. In addition, pressure created within the drying chamber 24 by one or both of the fans 52 and 56 may assist in movement of the grain debris 62 using the suction device 76.

INDUSTRIAL APPLICABILITY

The present disclosure may be applicable to grain bins having a perforated platform, such as a grain dryer screen, with a support surface for supporting grain. Further, the present disclosure may be applicable to such grain bins having an airflow, such as a drying airstream, flowing through the perforated platform. In particular, the present disclosure has applicability to a system and method for cleaning grain debris from an opposing surface, opposite the support surface, of the perforated platform.

Referring generally to FIGS. 1-10, an exemplary grain bin 10 may generally include a floor 12, a sidewall 14, and a conical roof 16. The grain bin 10 may also include a top dry grain drying system 18 (FIGS. 1 and 10) and, therefore, may be suitable for both drying and storing a bulk material, such as, for example, corn. The top dry grain drying system 18 is positioned generally at a top portion of the grain bin 10 and includes a grain dryer screen 20 separating an overhead drying chamber 24 and a holding area 38 below the overhead drying chamber 24. During use, grain may be received into the overhead drying chamber 24 through a central opening 28 of the roof 16 and may be distributed across a grain contacting surface 22 of the grain dryer screen 20. A fan 52 may direct ambient air heated using a heating device 54 through the sidewall 14 of the grain bin 10 and into the overhead drying chamber 24 through openings or perforations of the grain dryer screen 20. In addition, ambient air from a cooling fan 56 may capture heat from the previously dried grain 36 in the holding area 38 and also advance along a drying airflow path 32 through the grain dryer screen 20. After passing through the layer of wet grain 26 supported on the grain contacting surface 22 of the grain dryer screen 20, the drying airstream 58 may exit the grain bin 10 through one or more auto-vents 60, carrying moisture it absorbed from the heated grain.

When the layer of wet grain 26 has been dried to a predetermined level, dump chutes 34 may be actuated, or opened, to let hot dried grain 36 fall to the holding area 38 below, where the hot dried grain 36 is cooled and stored. For example, a motor 40, or other source of mechanical power, may be used to lower, and then raise, the dump chutes 34. As shown in FIG. 1, free ends 44 of the dump chutes 34 may be maintained in raised positions by chains 46 supported from a common platform 48. The motor 40 may then be used to reposition an actuation cable 50 to lower the free ends 44 of the dump chutes 34 (as shown in FIG. 10) and then reverse that repositioning of the actuation cable 50 to return the free ends 44 of the dump chutes 34 to the raised positions (FIG. 1).

Grain debris 62, including dust, may separate from the grain, or other bulk material, during various stages of processing and may be present with the grain during drying. As the dried grain 36 is dropped through the dump chutes 34 to the grain bin floor 12, the grain debris 62, which may be relatively lightweight and less dense, may float in the air space of the grain bin 10. For example, corn chaff, also known as bee's wings, which may become separated from the corn, may be suspended in the air above the dried grain supported on the grain bin floor 12. As the drying airstream 58, generated by the fans 52 and 56, flows along the drying airflow path 32, the grain debris 62 may be captured by the drying airstream 58 and, as it passes through the grain dryer screen 20, may collect, and may remain collected, on a grain debris contacting surface 64 of the grain dryer screen 20. This collection of grain debris 62 may restrict airflow through the grain dryer screen 20 to a point that significantly slows the drying and, thus, harvesting, process. In addition, the dust and debris associated with some bulk materials that may be processed using the grain bin 10 may present a potential fire hazard when collected along the grain debris contacting surface 64.

This problem, the extent of which may be previously unrecognized, may be detected based on observed positioning of dampers of the auto-vents 60. For example, if airflow through the grain dryer screen 20 is substantially restricted by the collection of grain debris 62 across the grain debris contacting surface 64, the dampers of the auto-vents 60 may not be pivoted to the extent they would normally be without the airflow obstruction. To remove the grain debris 62 collected on the grain debris contacting surface 64 of the grain dryer screen 20, even while the fans 52 and 56 and heating device 54 are being operated, the cleaning system 66 and method of the present disclosure may be employed.

The cleaning system 66, which may be installed before or after initial construction of the grain bin 10, may include a set of channeled cleaning arms 90, as shown in FIG. 3, having radial orientations relative to a central axis $A_1$ through the grain debris contacting surface 64. The channeled cleaning arms 90 may be disposed between adjacent rafters 96 of the grain dryer screen 20 and may be supported against the grain debris contacting surface 64 using a cable system 102. The cleaning system 66 may also include a cleaning assembly powering system 106 configured to move the channeled cleaning arms 90 relative to the grain debris contacting surface 64 using the cable system 102. In particular, the cleaning assembly powering system 106 may be configured to move a powered cable 110 passing through the channeled cleaning arms 90 and the rafters 96. As described above, the cable system 102 may include mechanisms 112 for attaching the channeled cleaning arms 90 to the powered cable 110 such that the channeled cleaning arms 90 move with the powered cable 110. The channeled cleaning arms 90 may be movable with respect to the non-powered cables 104, which assist in maintaining a desired distance between the channeled cleaning arms 90 and the grain debris contacting surface 64.

As the channeled cleaning arms 90 are moved, the grain debris 62 may be removed from the grain debris contacting surface 64. In particular, the grain debris 62 may be pulled into the channeled bodies 120 of the channeled cleaning arms 90 using suction generated by a suction device 76. According to the exemplary embodiment, the grain debris 62 may be pulled through the channeled cleaning arms 90 and into a central manifold 74 (FIG. 8) positioned upstream relative to the suction device 76. The grain debris 62 may be removed from the grain bin 10, using the suction device 76, to a predetermined location outside the grain bin 10. The channeled cleaning arms 90 may also be provided with bristles 126 (FIGS. 5 and 6) for brushing the grain debris 62 away from the grain debris contacting surface 64. The bristles 126 may assist in dislodging grain debris 62 from the grain debris contacting surface 64 and may be positioned to dislodge grain debris 62 such that the grain debris 62 may thereafter be suctioned through the channeled cleaning arms 90.

The movement of the actuation cable 50, which may be powered by the motor 40, may also be used to drive the cable system 102. For example, the motor 40 may be configured to simultaneously drive the cable system 102 and actuate the dump chutes 34 of the grain bin 10. To effect such simultaneous movement, the actuation cable 50 and the powered cable 110 of the cable system 102 may be coupled to move together, as shown in FIG. 9. In particular, pulleys 150 may be used to change direction of the powered cable 110 such that at least a segment 152 of the powered cable 110 is substantially aligned with the actuation cable 50. The pulleys 150 may be attached to the rafters 96 using angled brackets 154, or other known attachments means.

The cleaning system 66 and method disclosed herein provides a means for removing grain debris 62 from the grain debris contacting surface 64 of the grain dryer screen 20. As such, the overall efficiency of the grain drying and harvesting processes may be improved. According to some embodiments, the cleaning system 66 may be integrated with another system of the grain bin 10, such as the top dry grain drying system 18, such that the power source for the other grain bin system is used to simultaneously power the cleaning system 66. Although a specific embodiment is described, it should be appreciated that various implementation changes may be made without deviating from the scope of the present disclosure.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A system for cleaning a grain dryer screen, comprising:

a grain bin having an overhead drying chamber defined at least in part by the grain dryer screen and a roof of the grain bin;

the grain dryer screen supported within the grain bin and having a grain contacting surface for supporting grain opposing a grain debris contacting surface;

a drying airflow path through the grain dryer screen defined sequentially by the grain debris contacting surface and the grain contacting surface;

a cleaning assembly including a first cleaning arm mounted within the grain bin and disposed along the grain debris contacting surface; and a cleaning assembly powering system configured to move the first cleaning arm along a predetermined cleaning path relative to the grain debris contacting surface.

2. The system of claim 1, wherein the first cleaning arm includes a channeled body defining an interior space in fluid communication with a suction device for generating suction through the channeled body.

3. The system of claim 2, wherein the first cleaning arm further includes a strip of bristles extending along a longitudinal axis of the first cleaning arm and positioned such that free ends of the bristles contact the grain debris contacting surface.

4. The system of claim 2, wherein the cleaning assembly includes a set of channeled cleaning arms that includes the first cleaning arm, wherein each channeled cleaning arm has a radial orientation relative to a central axis through the grain debris contacting surface.

5. The system of claim 4, wherein an innermost end of each channeled cleaning arm relative to the central axis opens at a central manifold positioned upstream relative to the suction device.

6. The system of claim 4, wherein each channeled cleaning arm has a range of movement limited to cover a wedge-shaped portion of the grain debris contacting surface.

7. The system of claim 6, wherein the cleaning assembly powering system is configured to move each channeled cleaning arm in a first direction about the central axis and a second direction about the central axis that is opposite the first direction.

8. The system of claim 1, wherein the cleaning assembly includes a set of cleaning arms that are interconnected with a cable system for simultaneous movement along the predetermined cleaning path, wherein the set of cleaning arms includes the first cleaning arm.

9. The system of claim 8, wherein the cleaning assembly powering system includes a motor configured to drive the cable system.

10. The system of claim 9, wherein the motor is configured to simultaneously drive the cable system and actuate a dump chute of the grain bin.

11. The system of claim 1, wherein the grain dryer screen has a conical shape.

12. A method for cleaning a grain dryer screen supported within a grain bin, wherein the grain bin has an overhead drying chamber defined at least in part by the grain dryer screen and a roof of the grain bin, wherein the grain dryer screen has a grain contacting surface opposing a grain debris contacting surface, wherein a drying airflow path through the grain dryer screen is defined sequentially by the grain debris contacting surface and the grain contacting surface, the method comprising steps of:

supporting grain in the overhead drying chamber with the grain dryer screen;

supporting a first cleaning arm of a cleaning assembly within the grain bin and along the grain debris contacting surface of the grain dryer screen;

collecting grain debris from a drying airstream flowing along the drying air flow path at the grain debris contacting surface;

moving the first cleaning arm along a predetermined cleaning path relative to the grain debris contacting surface using a cleaning assembly powering system; and removing the grain debris from the grain debris contacting surface during the step of moving the first cleaning arm.

13. The method of claim 12, wherein the removing step includes pulling the grain debris into a channeled body of the first cleaning arm using suction generated by a suction device.

14. The method of claim 13, wherein the removing step further includes brushing the grain debris away from the grain debris contacting surface using a strip of bristles extending along a longitudinal axis of the first cleaning arm.

15. The method of claim 13, wherein the moving step includes simultaneously moving a set of channeled cleaning arms relative to the grain debris contacting surface, wherein the set of channeled cleaning arms includes the first cleaning arm and is interconnected using a cable system.

16. The method of claim 15, wherein the removing step further includes pulling grain debris through the channeled cleaning arms and into a central manifold positioned upstream relative to the suction device.

17. The method of claim 15, further including maintaining a radial distribution of the channeled cleaning arms relative to a central axis through the grain debris contacting surface during the step of simultaneously moving the channeled cleaning arms.

18. The method of claim 17, wherein the step of simultaneously moving the channeled cleaning arms includes moving the channeled cleaning arms in a first direction about the central axis and moving the channeled cleaning arms in a second direction about the central axis that is opposite the first direction.

19. The method of claim 12, further including:

simultaneously moving a set of cleaning arms relative to the grain debris contacting surface, wherein the set of cleaning arms includes the first cleaning arm and is interconnected using a cable system; and driving the cable system using a motor of the cleaning assembly powering system.

20. The method of claim 19, further including using the motor to:

simultaneously lower a dump chute of the grain bin and move the cleaning arms in a first direction; and simultaneously raise the dump chute and move the cleaning arms a second direction.

* * * * *